United States Patent [19]

Yamada et al.

[11] Patent Number: 4,780,062

[45] Date of Patent: Oct. 25, 1988

[54] PIEZOELECTRIC FAN

[75] Inventors: Yasuo Yamada; Katsumi Fujimoto; Jiro Inoue, all of Nagaokakyo, Japan

[73] Assignee: Murata Manufacturing Co., Ltd., Japan

[21] Appl. No.: 916,522

[22] Filed: Oct. 8, 1986

[30] Foreign Application Priority Data

Oct. 9, 1985 [JP] Japan ..... 60-154701[U]
Oct. 9, 1985 [JP] Japan ..... 60-154702[U]

[51] Int. Cl.[4] ..... F04B 35/04

[52] U.S. Cl. ..... 417/322; 417/436; 310/316; 310/321; 310/332

[58] Field of Search ..... 417/322, 436, 410; 416/81, 83; 310/321, 316, 332, 330, 331

[56] References Cited

U.S. PATENT DOCUMENTS 3,902,365 9/1975 Knauth ..... 73/861.03
4,144,790 3/1979 Suchoff ..... 84/DIG. 4
4,178,526 12/1979 Nakamura et al. ..... 310/326
4,205,267 5/1980 Williams ..... 324/458
4,472,654 9/1984 Nakamura et al. ..... 310/321
4,498,851 2/1985 Kolm et al. ..... 417/322
4,697,116 9/1987 Nakamura et al. ..... 310/321

*Primary Examiner*—Donald E. Stout
*Attorney, Agent, or Firm*—Ostrolenk, Faber, Gerb & Soffen

[57] ABSTRACT

A piezoelectric fan includes a tuning-fork type vibrator having two sides. A first piezoelectric element is formed on each of the two sides of the vibrator. Further, an exciting electrode is formed on each of these first piezoelectric elements. Also, a feedback electrode is formed on one of the first piezoelectric elements an electrically insulated from the exciting electrode. Furthermore, a blade is attached to the tip of each of the two sides of the vibrator. Then, this piezoelectric fan is driven in a self-exciting fashion by feeding an output from the feedback electrode to the exciting electrode. Also, in this piezoelectric fan, a vibrational node is formed at nearly the middle point of the vibrator at free vibration.

11 Claims, 4 Drawing Sheets

PIEZOELECTRIC FAN

BACKGROUND OF THE INVENTION

1. Field of the Invention

The present invention relates to a piezoelectric fan. More specifically, the present invention relates to a piezeoelectric fan using a bending vibrator such as a bimorph vibrator.

2. Description of the Prior Art

The conventional piezoelectric fan which is the background of the present invention is disclosed, for example, in the specification of the U.S. Pat. No. 4,498,851. The piezoelectric fan disclosed in this U.S. patent has a bimorph vibrator having a cantilever structure, being driven by a drive circuit of separated excitation type.

In such a conventional piezoelectric fan, a supporting part of the cantilever is required to be fixed in an ideal manner, but practically, the supporting part is usually formed integrally in one-piece with a case, and is fastened by bolts or fixed by an adhesive to this case. The mass of such a case is finite, and accordingly the supporting part and the case whereon it is mounted vibrate. Not only is this vibration transmitted to the equipment whereon the piezoelectric fan is mounted, and exerts an adverse effect on the equipment, but also the amplitude at the tip of an elastic blade is reduced by vibration of the supporting part, resulting in a reduction in the quantity or speed of the wind. Accordingly, the conventional piezoelectric fan having a cantilever structure is not so good in efficiency.

Also, the conventional piezoelectric fan is driven by the drive circuit of separated excitation type, and therefore the drive circuit cannot respond to the resonance frequency, as oscillation of the vibrating part becomes unstable. This results in a reduction in the wind quantity when the resonance frequency of the vibrating part is varied. Variation of the resonance frequency may be caused by an environmental change such as a temperature change, a change with time or the like, or by an adhesion of, for example, adhesive material to the blade attached to the tip of the vibrator. In the conventional piezoelectric fan, when the resonance frequency is varied, readjustment is required to coincide the resonance frequency with the driving frequency. However, practically such a readjustment is very difficult to make.

SUMMARY OF THE INVENTION

Therefore, the principal object of the present invention is to provide a piezoelectric fan having a good efficiency and less reduction in the wind quantity due to the above-mentioned problems.

The present invention relates to a piezoelectric fan comprising a tuning-fork type vibrator having two sides which have tips, a first piezoelectric element formed on each of these two sides, an exciting electrode formed on each of these first piezoelectric elements, a feedback electrode which is formed on one of the first piezoelectric elements and electrically insulated from the exciting electrode and from which an output is fed to the exciting electrode, and a blade secured to on each of the tips of the two sides.

When the output of the feedback electrode is fed to the exciting electrode, the piezoelectric fan is driven in a self-exciting fashion. When the piezoelectric fan is driven, the tuning-fork type vibrator oscillates and each of the blades formed on the tips thereof resonates, and thereby the wind is generated by the free end of each blade.

In accordance with the present invention, the piezoelectric fan is driven in a self-exciting fashion, and therefore it is not necessary to readjust it to compensate for a reduction in the wind power due to, for example, an environmental change or a change with time. Also, in the vibration of the vibrator, a node is produced at nearly the middle point thereof in free vibration, and accordingly, by supporting that part, no vibration leakage from the supporting part takes place. Accordingly, a piezoelectric fan having a good efficiency and no reduction in the wind quantity is obtainable.

These objects and other objects, features, aspects and advantages of the present invention will become more apparent from the following detailed description when taken in conjunction with the accompanying drawings.

DESCRIPTION OF THE PREFERRED EMBODIMENTS

Figure 1:
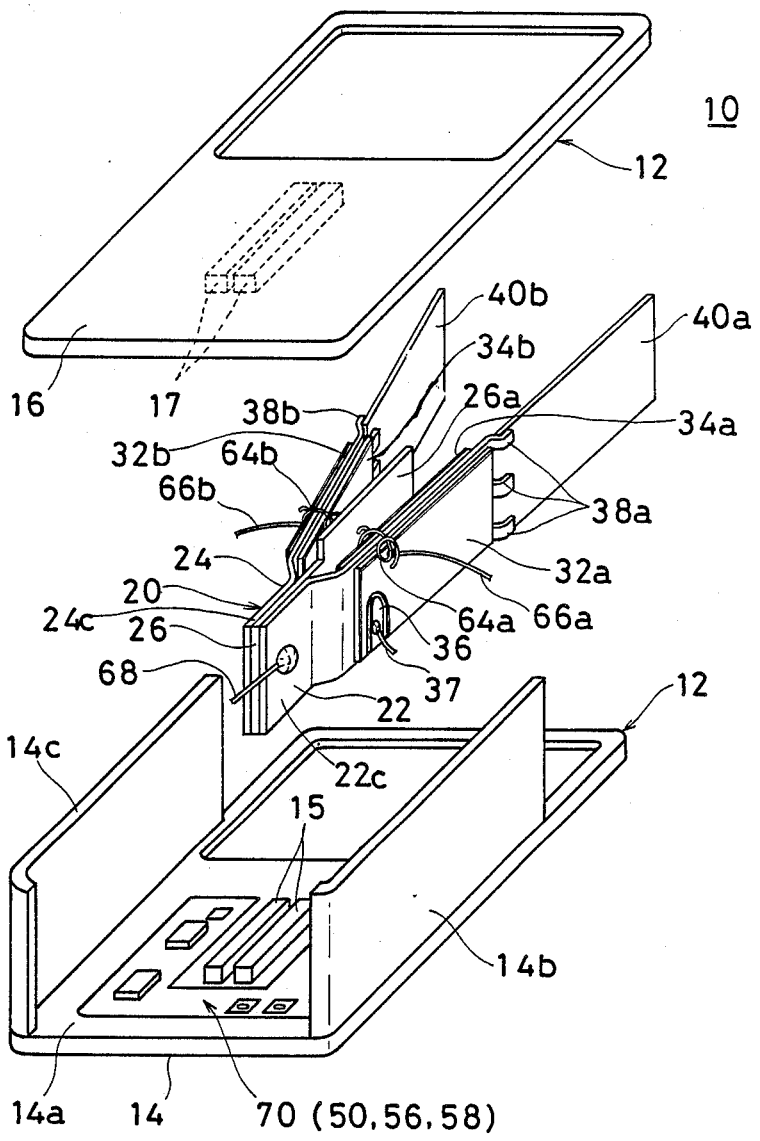
FIG. 1 is an exploded perspective view showing one embodiment in accordance with the present invention.

FIG. 1 is an exploded perspective view showing one embodiment in accordance with the present invention. A piezoelectric fan 10 comprises a case 12 composed, for example, of synthetic resin. The case 12 comprises a main unit 14 and a lid 16. The main unit 14 has a nearly square hole at the center rear part thereof and comprises a rectangular-plate-shaped bottom 14*a*, in which the hole is formed. At both sides of the bottom 14*a* excluding the rear part, a right wall 14*b* and a left wall 14*c* are formed integrally with the bottom 14*a*, extending nearly vertically from the bottom 14*a*.

In this case, the bottom 14*a* of the main unit 14 is formed having such dimensions that the front side is, for example, 40 mm, the rear side is, for example, 40 mm, and the front-to-rear length is, for example, 75 mm. Furthermore, on the center front part of the top surface of the bottom 14*a*, two mounting protrusions 15, 15 which are elongated in the front-to-rear direction are formed, with an interval between them in the right-to-left direction. Also, the lid 16 is formed nearly symmetrically to the bottom 14*a* of the main unit 14. This means that the lid 16 has a nearly square hole at the center rear part thereof and is formed in a rectangular plate shape, and has, at the center front part of the bottom surface thereof, two mounting protrusions 17, 17 which are elongated in the front-to-rear direction, and which are formed with an interval between them in the right-to-left direction. This lid 16 is fixed to the top ends of the right wall 14*b* and the left wall 14*c* of the main unit 14, for example, by an adhesive. In this case, a tuning-fork type vibrator 20 and other components are supported between the mounting protrusions 15, 15 of the main unit 14 and between the mounting protrusions 17, 17 of the lid 16.

Figure 3:
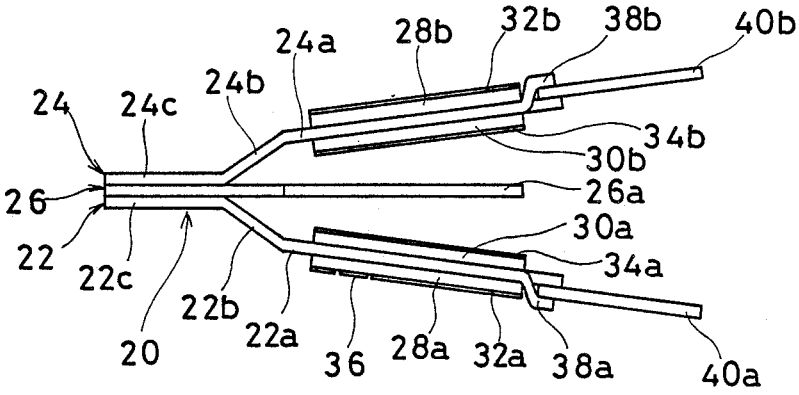
FIG. 3 is an illustrative view of the major component of the embodiment of FIG. 1.

As shown in FIG. 3 particularly, the vibrator 20 comprises two side members 22 and 24. The side member 22 comprises a narrow-tablet-shaped vibrating part 22*a*, and a connecting part 22*b* is formed extending from the one end of the vibrating part 22*a* at an angle with the vibrating part 22*a*, and a supporting part 22*c* is formed extending from the one end of the connecting part 22*b* at an angle with the connecting part 22*b*. Also, the side member 24 comprises a narrow-tablet-shaped vibrating part 24*a* in symmetry to the side member 22. Thus, a connecting part 24*b* and a supporting part 24*c* are formed in that order extending from the one end of the vibrating member 24*a* at respective angles therewith. These side members 22 and 24 are formed of a constant elasticity metallic material, for example, 42Ni and have such dimensions that the thickness is, for example, 0.2 mm, the length in the up-to-down direction is, for example, 12 mm, and the lengths in the front-to-rear direction of the vibrating parts 22*a* and 24*a* are, for example, 35 mm, respectively. In this case, the side members 22 and 24 are formed for example, by bending a belt-shaped constant elasticity metallic material alternately at two places respectively. Then, these side members 22 and 24 are fixed to a supporting plate 26 with the supporting plate 26 sandwiched between the supporting parts 22*c* and 24*c*. Accordingly, a tuning-fork type vibrator 20 having two sides is formed by the side members 22 and 24.

Also, since the supporting plate 26 is formed of a conductor such as a constant elasticity metallic material, for example, 42Ni, the side members 22 and 24 are connected electrically to the supporting plate 26. In addition, the side members 22 and 24 are fixed to the supporting plate 26, for example, by means of an adhesive, welding or a fastener such as a screw.

The supporting plate 26 comprises a supporting piece 26*a* which is formed extending between the vibrating parts 22*a* and 24*a* of the side members 22 and 24. This supporting piece 26*a* is formed so that the top edge thereof extends upward beyond the top edges of the vibrating parts 22*a* and 24*a* and the bottom edge thereof extends downward beyond the bottom edges of the vibrating parts 22*a* and 24*a*. Then, the bottom and the top edges of the supporting piece 26*a* are inserted respectively between the mounting protrusions 15, 15 of the main unit 14 and between the mounting protrusions 17, 17 of the lid 16. Thereby, the vibrator 20 and other components are supported in the case 12.

A first piezoelectric element 28*a* and a second piezoelectric element 30*a* are mounted on the vibrating part 22*a* of the side member 22 so as to sandwich it. The first piezoelectric element 28*a* and the second piezoelectric element 30*a* are formed of piezoelectric ceramics, for example, lead zirconate titanate (PZT).

Furthermore, exciting electrodes 32*a* and 34*a* are formed on the surfaces of the first piezoelectric element 28*a* and the second piezoelectric element 30*a*, respectively. Accordingly, a bimorph vibrator is constituted by the vibrating part 22*a* of the side member 22, the first piezoelectric element 28*a*, the second piezoelectric element 30*a*, and the exciting electrodes 32*a* and 34*a*. In addition, such a bimorph vibrator generates bending vibration in this embodiment.

Symmetrically with the vibrating part 22*a* of the side member 22, a first piezoelectric element 28*b* and a second piezoelectric element 30*b* are formed on the vibrating part 24*a* of the side member 24 so as to sandwich it, and a bimorph vibrator is constituted by forming the exciting electrodes 32*b* and 34*b* on the surfaces of the first piezoelectric element 28*b* and the second piezoelectric element 30*b*.

Furthermore, on the surface of the first piezoelectric element 28*a*, a feedback electrode 36 is formed, with electric insulation means being provided to insulate it from the exciting electrode 32*a*.

The material for the exciting electrodes 32*a*, 32*b*, 34*a* and 34*b* and the feedback electrode 36 may be, for example, nickel, aluminum, silver or gold.

Pinching claws 38*a* and 38*b* are formed respectively on the tips of the vibrating parts 22*a* and 24*a* of the side members 22 and 24, and by crimping these claws 38*a* and 38*b*, narrow-tablet-shaped blades 40*a* and 40*b* are attached to the tips of the vibrating parts 22*a* and 24*a*, respectively. These blades 40*a* and 40*b* are formed of an elastic material, for example, polyethyleneterephthalate and have such dimensions that the thickness is, for example, 0.188 mm, the length in the up-to-down direction is, for example, 12 mm, and the length in the front-to-rear direction is, for example, 28 mm. Thus, the vibrating parts 22*a* and 24*a* of the side members 22 and 24 and the blades 40*a* and 40*b* form a unit so as to resonate at a resonance frequency.

Figure 2:
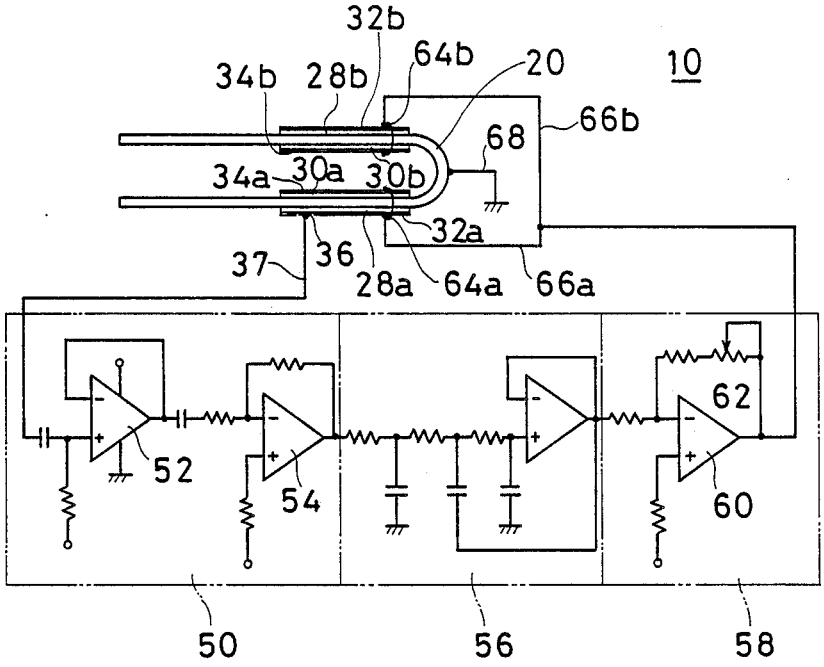
FIG. 2 is a circuit diagram of a circuit for use in the embodiment of FIG. 1.

A feedback loop, as shown schematically in FIG. 2, is connected between the feedback electrode 36 and the exciting electrodes 32*a*, 32*b*, 34*a* and 34*b*. An output from the feedback electrode 36 is fed to a wave shaping circuit 50 by a lead 37. This wave shaping circuit 50 comprises two operational amplifiers 52 and 54, shaping a sinusoidal wave from the feedback electrode 36 into a rectangular wave. The rectangular output from this wave shaping circuit 50 is fed to a low-pass filter 56 as one example of a filter for suppressing higher harmonics. The low-pass filter 56 may be an active filter using an active element as in this embodiment, and also may be a normal LC filter. The cut-off frequency of the low-pass filter 56 is set at or near the fundamental frequency of the bimorph vibrator of the piezoelectric fan 10.

The sinusoidal wave output from the low-pass filter 56 is fed to an amplifier circuit 58. The amplifier circuit 58 comprises an operational amplifier 60, and a variable resistor 62 for adjusting gain which is connected between the input and the output of this operational amplifier 60. The output of the amplifier circuit 58 is fed to the exciting electrodes 32*a*, 32*b*, 34*a* and 34*b*.

As shown in FIG. 1, the exciting electrodes 32*a* and 34*a* are connected by a spring 64*a* fitted on the bimorph vibrator comprising the vibrating part 22*a*, and the exciting electrodes 32*b* and 34*b* are connected by a spring 64*b* fitted on the bimorph vibrator comprising the vibrating part 24*a*. Further, a lead 66*a* is soldered to the exciting electrode 32*a* and the spring 64*a*, and a lead 66*b* is soldered to the exciting electrode 32*b* and the spring 64*b*. Then, these leads 66*a* and 66*b* are connected together to the output terminal of the amplifier circuit 58. Also, the vibrator 20 is grounded, for example, by a lead 68 soldered to the side member 22.

Thus, the drive circuit of self-excitation type is constituted. The feedback loop comprising the wave shaping circuit 50, the low-pass filter 56 and the amplifier circuit 58 is mounted around the mounting protrusions 15, 15 on the top surface of the bottom 14*a* of the main unit 14 on a circuit board 70 as shown particularly in FIG. 1. The weight of an example of the completed piezoelectric fan 10 was 25 grams.

Since this piezoelectric fan 10 is driven in a self-exciting fashion, readjustment for compensating a reduction in the wind power, for example, due to an environmental change can be dispensed with. Also, a vibrational node is produced at nearly the middle point of the vibrator 20, that is, at the supporting parts 22*c* and 24*c* of the side members 22 and 24 in free vibration. Since it is the supporting parts 22*c* and 24*c* that are supported, no a leakage of vibration through the supporting parts 22*c* and 24*c* takes place. According, this piezoelectric fan 10 has a good efficiency and no reduction in the wind quantity.

Figure 4:
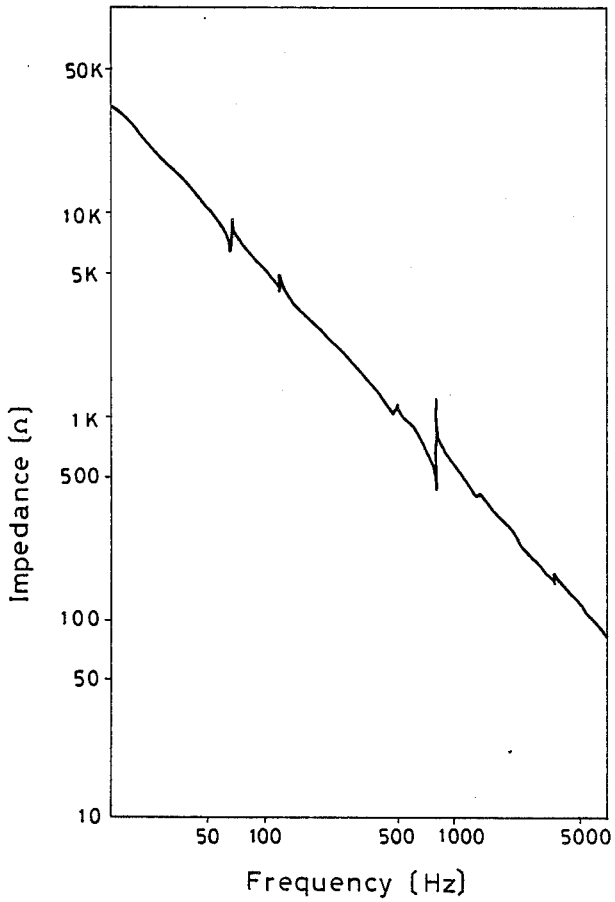
FIG. 4 is a graph showing frequency characteristics of the embodiment of FIG. 1, wherein the abscissa represents the frequency and the ordinate represents the impedance.

In the piezoelectric fan 10 of this embodiment, a signal from the feedback electrode 36 is shaped into a rectangular wave by the wave shaping circuit 50, and this signal of rectangular wave is given to the low-pass filter 56. Since the cut-off frequency of the low-pass filter 56 is set near the fundamental frequency of the piezoelectric fan 10, the output of the low-pass filter 56 becomes a sinusoidal wave having only a component of the fundamental frequency. This sinusoidal wave is amplified up to a voltage required for the vibrator by the amplifier circuit 58. This amplified driving voltage is applied to the exciting electrodes 32*a*, 32*b*, 34*a* and 34*b*. Accordingly, the piezoelectric fan 10 of this embodiment has frequency characteristics as shown in FIG. 4, and does not generate vibrations of higher-order modes.

In addition, in the amplifier circuit 58 of the feedback loop, by adjusting the gain of the operational amplifier 60 by the variable resistor 62, a trapezoidal wave is obtainable as a drive signal in place of the sinusoidal wave. If a trapezoidal wave is applied to the exciting electrodes 32*a*, 32*b*, 34*a* and 34*b*, an incidental effect is that the speed of the wind from the piezoelectric fan 10 can be increased. The reason is that if a trapezoidal wave whose fundamental component is the fundamental vibration frequency of the piezoelectric fan is used as a drive signal, the increased an acceleration which occurs with the rapid rise of the trapezoidal wave continues to displace the vibrator by inertia, even while the trapezoidal wave is at its constant peak voltage, and therefore the amplitude of the fan movement is increased, and thereby the wind speed is increased.

In addition, the driving voltage may be increased for increasing the wind speed, but this causes noise components of higher harmonic waves to be increased, and thereby a noise level of the piezoelectric fan is increased. On the other hand, when the trapezoidal wave is used, even if the driving voltage is increased, the noise level of the piezoelectric fan is hardly increased.

Experimental example:

First, the piezoelectric fan as shown in FIG. 1 was prepared as a sample, and the piezoelectric fan disclosed in the specification of the U.S. Pat. No. 4,498,851 was prepared as a conventional example. Further, a piezoelectric fan having a so-called cantilever structure, wherein case 12 and the one of the side members 22 were removed from the FIG. 1 embodiment, was prepared as an example for comparison.

Then, the sample, the conventional example and the example for comparison were driven by signals having power of the same magnitude, and the amount of displacement l(mm) of the tip of the blade and the resonance frequency f(Hz) were measured. In this case, for the sample for comparison, measurements were made in the case where additional masses of 1.5 g, 10 g, 25 g, 40 g and 2,600 g were attached to the supporting part 24*c* of the side member 24 and the whole was supported. In addition, the additional mass of 2,600 g is the mass when the supporting part 24*c* of the example for comparison is pinched by a vise. The following table shows the results of this experiment.

TABLE

| | Sample | Conventional example | Example for comparison | | | | |
|---|---|---|---|---|---|---|---|
| Additional Mass (g) | | | 1.5 | 10 | 25 | 40 | 2,600 |
| Amount of displacement l (mm) | 9.2 | 5.5 | 2.4 | 3.5 | 5.5 | 5.8 | 9.8 |
| Resonance frequency f(Hz) | 62.5 | 60.0 | 86.1 | 69.9 | 64.5 | 63.0 | 62.4 |
| l × f | 575 | 330.0 | 206.64 | 244.65 | 354.75 | 365.4 | 611.52 |

Normally, as shown by the following expression, a wind velocity V is proportional to a product of an amount of displacement l(mm) of the tip of the blade and a resonance frequency f(Hz).

$$\text{Wind velocity} \propto \text{Amount of displacement } l(\text{mm}) \times \text{Resonance frequency } f(\text{Hz})$$

Thus, considering that the wind velocity V is proportional to a product of the amount of displacement l(mm) and the resonance frequency f(Hz), the experimental results as shown in the table show that the sample can obtain a wind velocity more than 1.5 times that of the conventional example. Also, the table shows that, in the example for comparison, the smaller the additional mass for supporting the supporting part of the side member is, the slower the wind velocity is. Then, it is found that, in the example for comparison, even if an additional mass as large as practically possible is attached, that is, even if the additional mass of 40 g is attached, only a wind velocity smaller than the wind velocity obtained by the sample is obtainable. In other words, in the sample, a wind quantity is obtainable which is 1.5 times or more larger than that even in the case of the example for comparison where an additional mass as large as practically possible is attached. This is because the sample is driven in a self-exciting fashion and the leakage of the vibration through the supporting part of the sample's vibrator is small in comparison with the conventional example and the example for comparison.

In addition, the table shows that, in the example for comparison, even if a large additional mass that is impossible practically, for example, an additional mass of 2,600 g is attached, the wind velocity is nearly equal to the wind velocity obtained by the sample.

Figure 5:
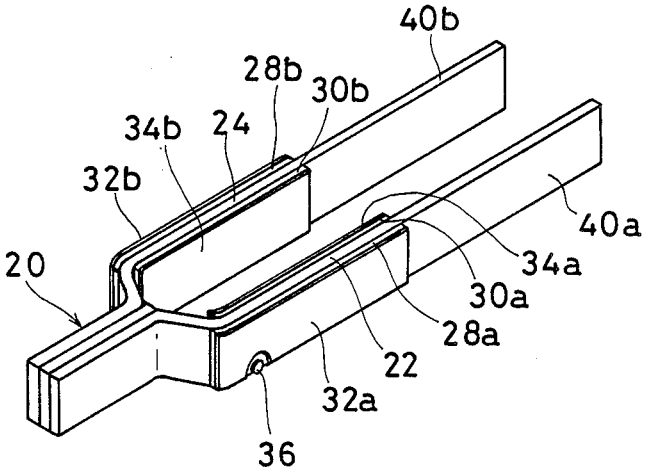
FIG. 5 is a perspective view of the major components of a modification of the embodiment of FIG. 1.

FIG. 5 is a perspective view of the major component of a modified example of the FIG. 1 embodiment. In the FIG. 1 embodiment, the blades 40*a* and 40*b* are constituted by members separate from the vibrator 20, but in this embodiment, the blades 40*a* and 40*b* are formed integrally with the vibrator 20, as the same member. Thus, by forming the blades 40*a* and 40*b* and the vibrator 20 in a one-piece fashion, the members and the process for attaching the blades 40*a* and 40*b* to the vibrator 20 can be dispensed with.

Figure 6:
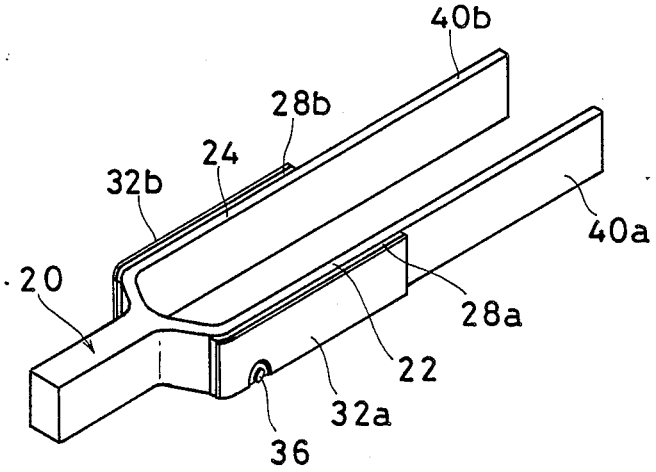
FIG. 6 is a perspective view of the major components of another modification of the embodiment of FIG. 1.

FIG. 6 is a perspective view of the major components of another modified example of the FIG. 1 embodiment. In this embodiment, the vibrator 20 and the two side members 22 and 24 are formed in a one-piece fashion. Thus, by forming the two side members 22 and 24 in a one-piece fashion, the members and labor for connecting the two side members 22 and 24 can be dispensed with.

Furthermore, in the embodiment as shown in FIG. 6, the second piezoelectric elements 30*a* and 30*b* are not installed on the vibrator 20. In the above-described respective embodiments of FIGS. 1–5, a bimorph vibrator is constituted by the first piezoelectric element and the second piezoelectric element and the other conmponents, but in this embodiment, a unimorph vibrator is constituted, since the second piezoelectric elements 30*a* and 30*b* and associated members are removed.

In the above-described embodiment, the low-pass filter 56 is employed as a filter for suppressing higher harmonic waves in the feedback loop, but a band-pass filter whose center frequency is the same as or near to the fundamental frequency of the piezoelectric fan may be used in place of this low-pass filter.

Furthermore, the above-described specific circuit of the feedback loop is only an exemplification, and, for example, a circuit configuration may be made using discrete components without using the operational amplifier.

Although embodiments of the present invention have been described and illustrated in detail, it is clearly understood that the same is by way of illustration and example only and is not to be taken by way of limitation, the spirit and scope of the present invention being limited only by the terms of the appended claims.

What is claimed is:

1. A piezoelectric fan comprising;

a tuning-fork type vibrator having two vibrating sides which have tips, a first piezoelectric element formed on a face of each of said two sides, an exciting electrode formed on each said first piezoelectric element, a feedback electrode which is formed on one of said first piezoelectric elements and electrically insulated from said exciting electrode, and from which an output is fed to said exciting electrode, and a fan blade secured to each of the tips of said two sides.

2. A piezoelectric fan in accordance with claim 1, which further comprises a second piezoelectric element which is formed on another face of each of each said vibrating side facing said first piezoelectric element, and constitutes a bimorph vibrator in cooperation with said first piezoelectric element and said vibrating side.

3. A piezoelectric fan in accordance with claim 1, which further comprises a feedback loop from said feedback electrode to feed said output to said exciting electrode.

4. A piezoelectric fan in accordance with claim 3, wherein said feedback loop comprises an amplifier circuit, an oscillation circuit being formed with said piezoelectric element and said amplifier circuit, and said output being fed to said exciting electrode from said oscillation circuit.

5. A piezoelectric fan in accordance with claim 4, which further comprises a filter for suppressing higher harmonic waves which is inserted into said feedback loop to suppress higher harmonic waves.

6. A piezoelectric fan in accordance with claim 1, wherein said two vibrating sides have connecting portions which are connected; and said vibrator is supported at a common vibrational node of said connecting portions connecting said two side members.

7. A piezoelectric fan in accordance with claim 1, wherein said vibrator and said blade are formed in a one-piece fashion with the same material.

8. A piezoelectric fan in accordance with claim 1, wherein said vibrator and said blades are formed of different materials.

9. A piezoelectric fan in accordance with claim 3, further comprising a second piezoelectric element which is formed on another face of each said vibrating side facing said first piezoelectric element, and constitutes a bimorph vibrator in cooperation with said first piezoelectric element and said vibrating side.

10. A piezoelectric fan in accordance with claim 5, wherein said output from said feedback electrode is fed directly to a wave-shaping circuit; said output to said exciting electrode is fed directly by said amplifier circuit; and a low-pass filter interconnects said wave-shaping circuit and said amplifier circuit.

11. A piezoelectric fan comprising:

a tuning-fork type vibrator having two vibrating sides which have tips, a first piezoelectric element formed on a face of each of said two sides, an exciting electrode formed on each said first piezoelectric element, a feedback electrode which is formed on one of said first piezoelectric elements and electrically insulated from said exciting electrode, and from which an output is fed to said exciting electrode, a fan blade secured to each of the tips of said two sides, which further comprises a feedback loop from said feedback electrode to feed said output to said exciting electrode, wherein said feedback loop comprises an amplifier circuit, an oscillation circuit being formed with said piezoelectric element and said amplifier circuit and said output being fed to said exciting electrode from said oscillation circuit, which further comprises a wave shaping circuit which is inserted into said feedback loop to shape said output given to said exciting electrode into a trapezoidal wave.

* * * * *